US005136931A

United States Patent [19]

Kita

[11] Patent Number: 5,136,931

[45] Date of Patent: Aug. 11, 1992

[54] ROTARY TYPE FLUID ENERGY CONVERTOR

[76] Inventor: Yasuo Kita, 3-5-9, Ooe-Kita-Kutsukake-Cho, Nishikyo-Ku, Kyoto-Shi, Kyoto-Fu, Japan

[21] Appl. No.: 679,427

[22] Filed: Apr. 2, 1991

[30] Foreign Application Priority Data

Apr. 4, 1990 [JP] Japan ..... 2-89692

[51] Int. Cl.[5] ..... F04B 1/10; F03C 1/24

[52] U.S. Cl. ..... 417/497; 92/12.1; 417/498

[58] Field of Search ..... 91/491, 497, 494, 498; 92/58, 12.1

[56] References Cited

U.S. PATENT DOCUMENTS

| | | | |
|---|---|---|---|
| 3,194,123 | 7/1965 | Feaster | 91/498 |
| 4,006,668 | 2/1977 | Steiger | 91/498 X |
| 4,033,237 | 7/1977 | Rutz | 91/498 X |
| 4,033,239 | 7/1977 | Gsching | 92/58 |
| 4,195,553 | 4/1980 | Klie | 91/497 |
| 4,813,340 | 3/1989 | Kita et al. | 91/498 X |

FOREIGN PATENT DOCUMENTS

| | | | |
|---|---|---|---|
| 1453628 | 10/1969 | Fed. Rep. of Germany | 91/498 |
| 64-8190 | 2/1989 | Japan . | |
| 958028 | 5/1964 | United Kingdom | 91/498 |

*Primary Examiner*—Leonard E. Smith

*Attorney, Agent, or Firm*—Ladas & Parry

[57] ABSTRACT

A rotary-type fluid energy convertor comprises a pair of cylindrical body members, a pintle inserted into the cylindrical body members and having a cylindrical central portion between the body members, a cylinder barrel mounted on an outer periphery surface of the central portion of the pintle, the cylinder barrel being provided with a plurality of spaces isometrically arranged in radial directions thereof, a plurality of bushings fitted into the spaces, a rotary body mounted to the body members to be rotatable and having an inner periphery sectioned into a plurality of flat surface portions against which the top flat portions of the bushings closely abut, respectively, so as to form pressure chambers therebetween, and high and low pressure side fluid passages formed between the cylinder barrel and the cylindrical portion of the pintle. the pintle is disposed so as to be movable parallel to a direction axially normal to the body members so that an amount of eccentricity between a center of the cylindrical portion of the pintle and a rotation center of the rotary body is to be adjustable. The pintle is provided with fluid passages which communicate the fluid inlet and outlet formed to the body members with ports formed to the high and low pressure side fluid passages. The body members is provided with a pair of high and low pressure side pressure chambers at portions symmetric with the high and low pressure side fluid passages, respectively.

6 Claims, 3 Drawing Sheets

ROTARY TYPE FLUID ENERGY CONVERTOR

BACKGROUND OF THE INVENTION

The present invention relates to a rotary-type fluid energy convertor particularly utilized as fluid pump or motor operated by static pressure.

Conventionally, there has been the practical application of rotary-type fluid energy convertors of the so-called "swash plate type or bent axis type" as a hydraulic pump or motor in which a pressure is converted into a driving torque.

In the rotary-type fluid energy convertors of the described type, the conversion of the pressure into the driving torque is carried out between the reciprocating motion and the rotating motion of a piston. And it is therefore necessary to arrange a complicated mechanism such as a cam mechanism and a link mechanism on the side of a rotary body. In addition, since the axis of the rotary body is inclined with respect to a direction of operation of a piston at a portion where the pressure is converted into the driving torque, a force in a direction inclined with respect to the rotating axis is applied to a coupling portion, i.e. roller bearing, between the piston and the rotary body. Therefore, it is necessary for the roller bearing to have an increased strength, resulting in a large structure at that portion, in the lowering of the lifetime of the roller bearing and in the increase of an energy loss, which are significant problems for a fluid pump or motor of the character described above.

In order to obviate these problems or defects, the inventor of this application conceived an improved rotary-type fluid convertor such as disclosed in Japanese Patent Publication No. 64-8190 (8190/1989) as well as Yasuo Kita, "YUATSU TO KUKIATSU" Vol. 20, No. 2 (March 1989), pp. 107–708. This improved rotary-type fluid energy convertor comprises: a first annular member; a second annular member mounted so as to be relatively rotatable on the inner peripheral surface of the first annular member through first static pressure bearings arranged intermittently in the circumferential direction of the first annular member; a plurality of seal bushings disposed at portions corresponding to the respective first static pressure bearings, each of the seal bushings having a front end located at the inner peripheral surface of the second annular member through a second static pressure bearing; a seal bushing holding member disposed at a portion eccentric with respect to the first and second annular members so as to form spaces having inner volumes on the bottom side of each seal bushing varies in response to the relative rotation between the first and second annular members; and paired fluid passages communicated respectively with spaces having inner volumes being increased and being decreased.

In such a fluid energy convertor, pressure guide passages are formed by the seal bushings and pressure guide passages are provided for the second annular member. The fluid filling in the respective spaces is guided into the first and second static pressure bearings through the corresponding pressure guide passages in such a manner that the static pressure of the fluid guided into the respective first static pressure bearings and the static pressure of the fluid guided into the respective second static pressure bearings are made resistive in accordance with the driving torque acting on an input-output shaft of the rotary body by the sum of the couple of forces acting to the second annular member.

According to the structure of the fluid pump or motor described above, a heavy load bearing is eliminated so that a compact and lightweight energy convertor can be realized, and which is capable of maintaining a predetermined performance in a long time period. Furthermore, the energy convertor can utilize a fluid having a low viscosity and can achieve a smooth operating condition from a stopping time to a high speed operation starting time.

However, according to the described fluid energy convertor, since it is necessary that the first and second annular members and other members located in association with these annular members all have tapered structures, it is necessary for the sliding portions between these members to be inclined with respect to the axis of the rotary body, which requires a troublesome working processes. Furthermore, since it is necessary to construct the first static pressure bearing so as to have a large diameter, the sliding speed thereof should be made fast, thus being inconvenient in view of energy loss or setting of a high speed limit.

SUMMARY OF THE INVENTION

An object of the present invention is to substantially eliminate defects or drawbacks encountered in the prior art and to provide an improved rotary-type fluid energy convertor having a compact structure capable of being easily assembled and effectively performing the energy conversion.

This and other objects can be achieved according to the present invention by providing a rotary-type fluid energy convertor comprising: a pair of cylindrical body members stationarily installed, having a fluid inlet/a fluid outlet; a pintle inserted into the cylindrical body members and having a cylindrical central portion positioned between the cylindrical body members; an annular cylinder barrel mounted on an outer peripheral surface of the cylindrical central portion of the pintle, the cylinder barrel being provided with a plurality of spaces formed in isometrically symmetric arrangement in radial directions thereof; a plurality of bushings fitted into and supported by the spaces, respectively, each of the bushings having a sealed outer end and a small hole; a cylindrical rotary body mounted to the body members to be rotatable and having an inner periphery sectioned into a plurality of flat surface portions against which the outer end of the bushings closely abut, respectively, so as to form pressure chambers each between the flat surface portion of the rotary body and the sealed outer end of the bushing; and fluid passage means including high and low pressure side fluid passages formed between the cylinder barrel and the cylindrical portion of the pintle, and wherein the pintle is disposed in the body members so as to be parallelly movable in a direction axially normal to the body members so that an amount of eccentricity between a center of the cylindrical portion of the pintle and a rotation center of the rotary body is be adjustable, the pintle is provided with fluid passages which communicate the fluid to the body members with ports formed to the high pressure side fluid passages, and the body members are provided with a pair of high and low pressure side pressure chambers at portions symmetric with the high and low pressure side fluid passages, respectively, and wherein a couple of forces, based on eccentricity between the center of the pintle and the rotation center of the rotary body, is caused by a force applied to the flat surface portions of the rotary body by the abutment of the top of the bushings and a force applied to inner surfaces on both the sides of the rotary body by pressures in the high and low pressure side pressure chambers, thereby causing a driving torque to the rotary body in proportion to the eccentricity and pressure difference.

Pressure chambers are formed to the inner surfaces of both the sides of the rotary body in accordance with the flat surface portions thereof, respectively, at portions with an angle of 180 degrees and the pressure chambers are communicated with the high and low pressure side pressure chambers of the body members.

According to the characters of the fluid energy convertor of the present invention described above, when the fluid energy convertor is operated as a motor, the pressurized fluid is supplied in the high pressure side fluid passage and the pintle is eccentrically parallelly moved in a direction normal to the axis of the pintle. Through this operation, the pressurized fluid in the fluid passage passes the spaces communicated with this passage, acts to the bushings and then flows into the pressure chambers through the holes formed to the top portions of the bushings. At this time, since the acting lines of the pressure acting to the flat surfaces of the rotary body are made eccentric with respect to the central line passing the center of the rotary body, the couple of forces is generated. Accordingly, the rotary body receives a rotating force corresponding to the sum of the couple of forces applied to the bushings in the high pressure side fluid passage. The inner volumes of the spaces in the high pressure side fluid passage gradually increase in accordance with the rotation of the rotary body and the inner volumes of the spaces in the low pressure side fluid passage gradually decrease, so that the high pressure fluid enters through the high pressure side fluid passage and the fluid after the working or operation is returned to the tank through the low pressure side fluid passage.

When the pintle is moved parallel in the direction normal to the axis of the pintle so that the axis of the pintle coincides with the rotation center of the rotary body, the axis of the bushing coincides with the radial line of the rotary body, whereby no couple of forces is caused and, hence, the rotating force of the rotary body becomes zero. When the pintle is further moved in the opposite direction, the rotation center of the rotary body is made eccentric in the direction opposite that described above, thus reversing the rotating force of the rotary body.

In a case where the fluid energy convertor of the present invention acts as a pump, when the rotary body is rotated by the external force, a couple of forces the same as that of described before corresponding to the high pressure side bushing, is generated by the fluid outlet pressure, which is made resistive against the driving torque. The fluid is sucked into the spaces, which are gradually increased in volume, through the low pressure side fluid passage in accordance with the rotation of the rotary body, and the fluid is forced out through the high pressure side fluid passage because the volumes of the spaces existing in the high pressure side fluid passage are decreased in accordance with the rotation of the rotary body. Accordingly, the pump operation stops by shifting the pintle to the neutral position and the direction of fluid flow is made reverse by further shifting the pintle towards the opposite side.

BRIEF DESCRIPTION OF THE DRAWINGS

For a better understanding of the present invention and to show how the same is carried out, reference is first made, by way of a preferred embodiment, to accompany drawings, in which.

DESCRIPTION OF THE PREFERRED EMBODIMENT

One preferred embodiment of a rotary-type fluid energy convertor according to the present invention will be described hereunder with reference to FIGS. 1 to 4.

Figure 1:
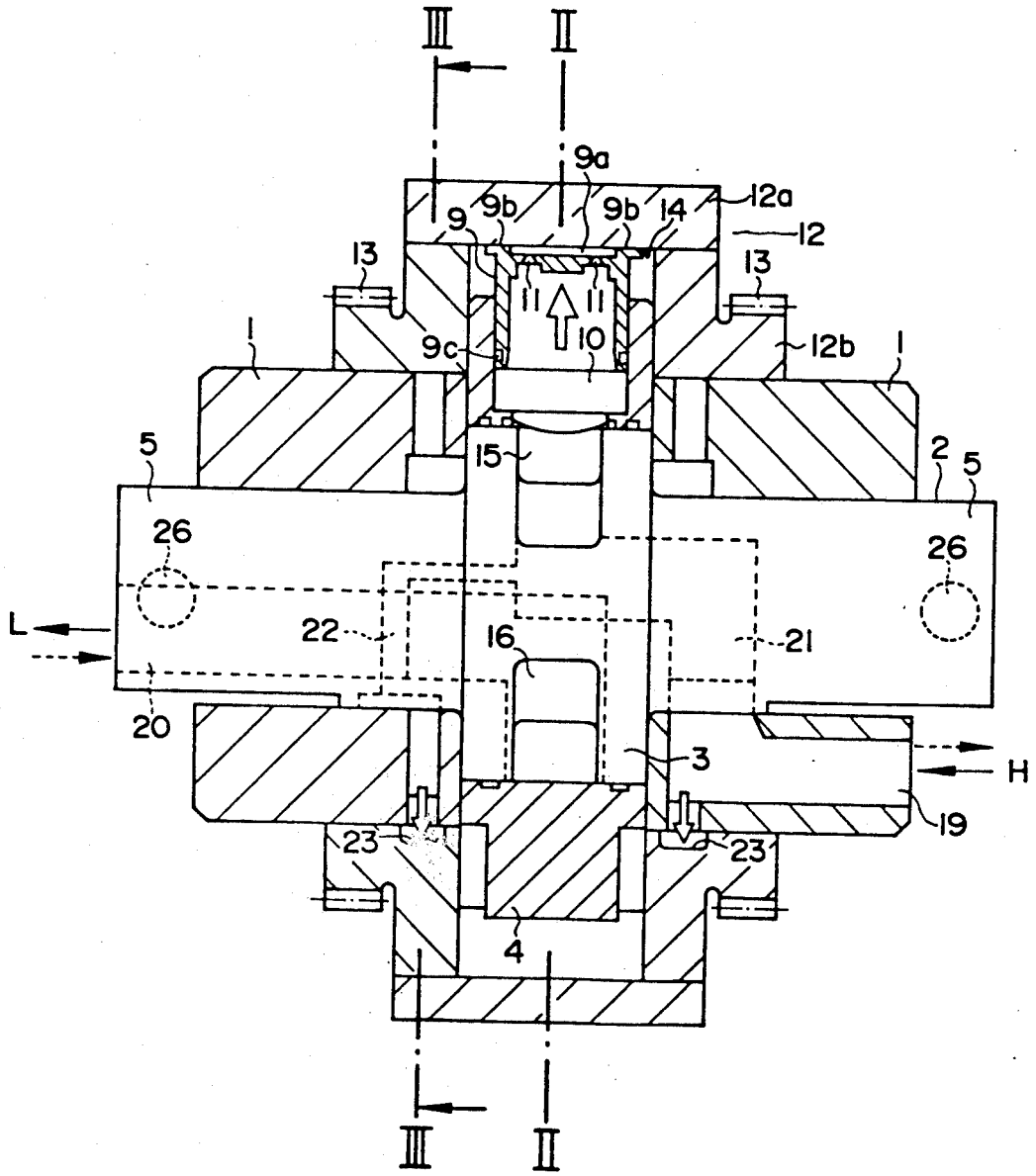
FIG. 1 is a longitudinal sectional view of a rotary-type fluid energy convertor according to the present invention.

Referring to FIG. 1, the rotary-type fluid energy convertor of the present invention comprises a pair of cylindrical main bodies 1 and 1 stationarily installed, one having a fluid inlet, i.e. suction side, and the other having a fluid outlet, i.e. outlet side. A pintle 2 is inserted through the bodies 1 and 1 in the axial direction thereof so that a cylindrical portion 3 of the pintle is positioned between the bodies 1 and 1. An annular cylinder barrel 4 is closely mounted on the outer periphery of the cylindrical portion 3 of the pintle 2 to be rotatable.

Figure 3:
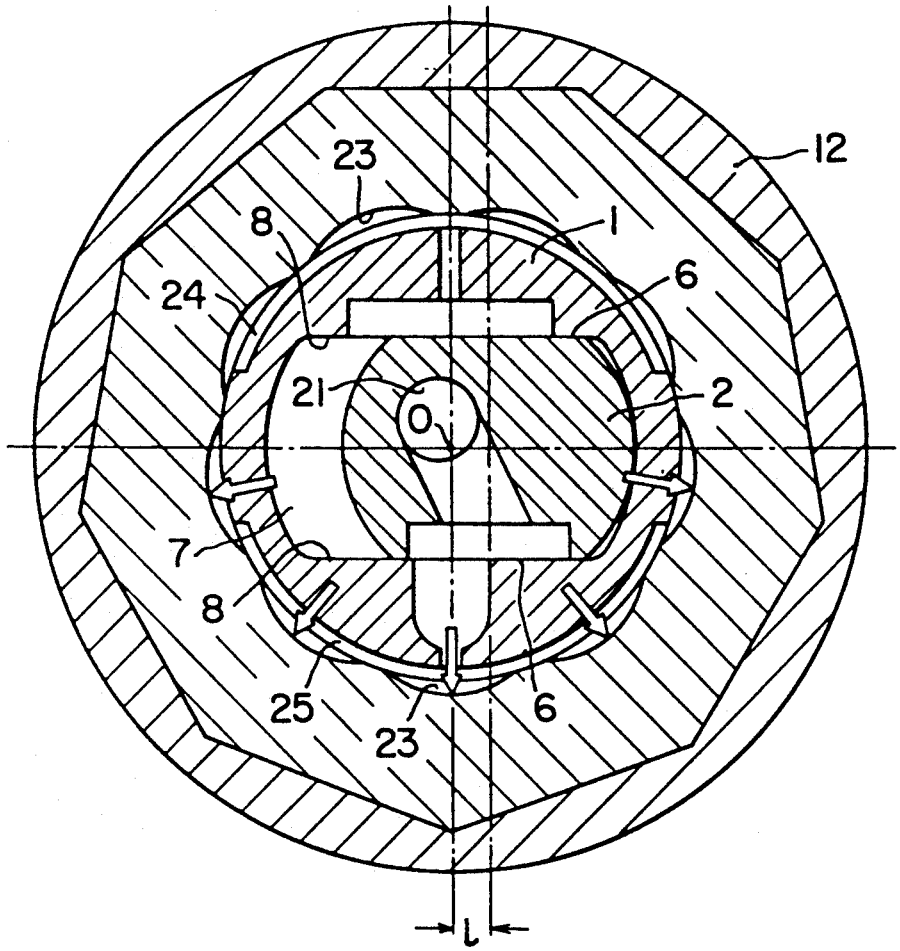
FIG. 3 is also a sectional view taken along the line III—III shown in FIG. 1.
Figure 4:
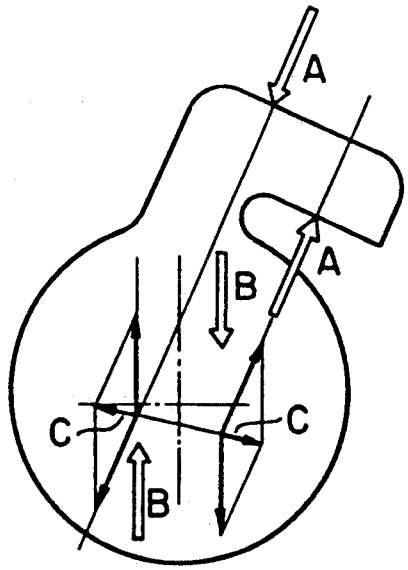
FIG. 4 is a view for the explanatory of the generation of couple of forces.

The pintle 2 is also provided with shaft portions 5 and 5 other than the cylindrical portion 3 on both sides thereof and the shaft portions 5 and 5 each have a flat surface portion 6, as shown in FIG. 3, formed by cutting the surface. The shaft portions 5 and 5 are fitted into holes 7 formed in the bodies 1 and 1 and the holes 7 have flat surfaces 8 and 8 corresponding to the flat surface portions 6 of the shaft portions 5 and 5 so as to be slidably engaged with each other when the axis portions are inserted into the holes 7. The holes 7 have a horizontal width larger than a diameter of the shaft portion 5 of the pintle 2 so that when the shaft portion 5 is inserted in an eccentric manner into the hole 7, the center of the shaft portion 5 is eccentric from the center of the hole 7 by a distance $\lambda$.

Figure 2:
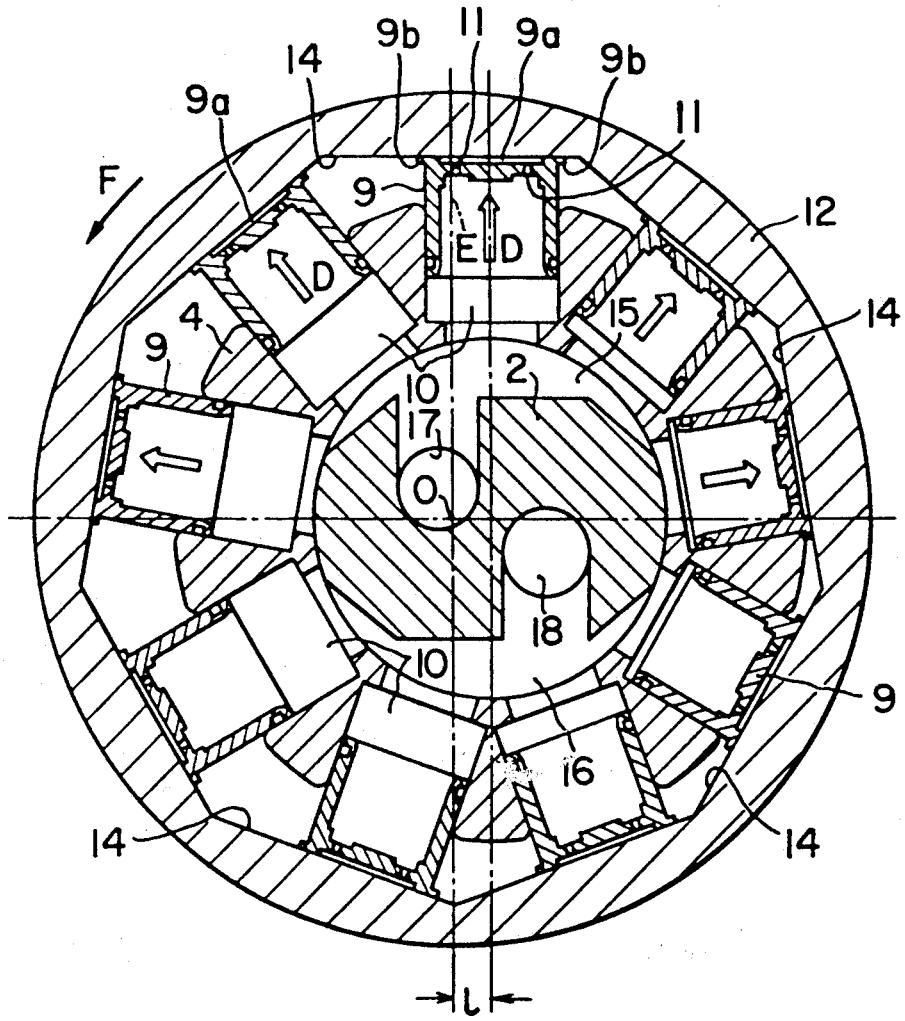
FIG. 2 is a sectional view taken along the line II—II shown in FIG. 1.

As shown in FIG. 2, an odd number (nine in the illustration) of bushings 9, 9 . . . 9 are disposed through piston rings **9*c* in the cylinder barrel 4 in an isometrical arrangement in spaces 10, 10 . . . 10 formed in the radial directions of the barrel 4 with respect to the center thereof in a slidable manner. Each of the bushings 9 has a cylindrical piston shape and has an outer end portion sealed, and a small hole 11** is formed to the sealed top end portion.

Outside these bushings 9, 9 . . . 9 is mounted a rotary body 12 consisting of an outer body **12*a* and an inner body 12*b*, which is closely mounted on the outer periphery of the main bodies 1 and 1 to be rotatable, and on the outer periphery of the inner body 12*b* are formed gears 13 and 13** carrying an output in the case of motor operation and carrying an input in the case of pump operation.

The rotary body 12 is provided with an inner wall surface formed in a plurality of flat portions 14, 14 . . . 14 (nine in the illustration) corresponding to the respective bushings 9, 9 . . . 9 and being normal to the axes of the bushings. The periphery *9b*, *9b* . . . *9b* of the top portions of the bushings 9, 9 . . . 9 closely abut against the corresponding flat surfaces 14, 14 . . . 14 with spaces between the flat surfaces 14, 14 . . . 14 and the inside portions of the periphery *9b*, *9b* . . . *9b* of the bushings, the spaces being formed as pressure chambers *9a*, *9a* . . . *9a*.

Further, as shown in FIG. 2, both the side of the cylindrical portion 3 of the pintle 2 are cut away to provide fluid passages 15 and 16 in point-symmetry arrangement and fluid ports 17 and 18, respectively on high and low pressure sides, are also formed near the center axes of the pintle 2. The high pressure side port 17 is communicated with a port 19 formed to the body 1 through a fluid passage 21 formed in the pintle 2 and the low pressure side port 18 is guided outward through a fluid passage 22 formed in the pintle 2.

Referring to FIG. 3, the rotary body 12 has an inner peripheral surface engageable with the bodies 1 and 1 and arcuate recesses 23 are formed to the inner peripheral surface of the rotary body 12 with an angle of 180 degrees in relation to the corresponding bushings 9, 9 . . . 9. These recesses 23 are classified into high and low pressure side groups and high and low pressure side pressure chambers are respectively formed to the recesses of the high and low pressure side groups by pressure guide passages 22, 24 and 25 formed to the bodies 1 and 1 at the high and low pressure side areas, respectively. It is desired for each of the recessed portions to have a sectional area about half that of the bushing 9 for ensuring a balance of force in the radial direction.

A central portion of each flat surface of the rotating body 12 and each pressure chamber on an inner surface on both side of the rotating body 12 may be communicated via pressure lead holes or pressure lead tubes so as to correspond to positions at every 180°.

The pintle 2 is moved to the eccentric position by the following means. Namely, referring to FIG. 1, in which only the locating positions are shown with chain lines, eccentricity controlling hydraulic cylinder means 26 and 26 are disposed at portions near both the axial ends of the pintle 2 in a direction normal to the axis of the pintle 2. The pintle 2 is bilaterally, as viewed, slid by the actuation of the cylinder means 26 and 26. Another moving means such as mechanical means may be utilized in place of the described hydraulic cylinder means.

The fluid energy convertor of the structures described above is operated in a manner which will be described hereunder.

First, supposing that the fluid energy convertor acts as a motor, when a pressurized fluid H as shown by a full line is supplied from the fluid inlet through the port 19 of the body 1, the pressurized fluid flows towards the fluid passage 15 through the fluid passage 21 and the port 17. In this time, when the pintle 2 is moved rightward as viewed in FIG. 3 to the eccentric position, the pressurized fluid in the fluid passage 15 acts to the bushings 9, 9 . . . 9 through the spaces 10, 10 10 which communicate with the fluid passage 15 and then enters the pressure chambers *9a*, *9a* . . . *9a* through the small holes 11 formed to the top portion of the bushings.

During the operations described above, since the acting direction D of the pressure of the fluid acting on the flat surface 14 of the rotary body 12 through the small hole 11 is made eccentric with respect to the central line E passing the rotation center O of the rotary body 12, the couple of forces is generated by the eccentric relation between the acting line D and the central line E along which the pressure in the pressure chamber (recess 23) formed to the inner surface of the rotary body 12 acts as shown in FIG. 3. Accordingly, there is caused a force to rotate the rotary body 12 in an arrowed direction F in FIG. 2 by the sum of the couple of forces generated in the pressure chambers and the pressure chambers *9a*, *9a* . . . *9a* of the bushings 9, 9 . . . 9 of the high pressure side fluid passage 15. The inner volumes of the spaces 10, 10 . . . 10 formed in the fluid passage 15 gradually increase in accordance with the rotation of the rotary body 12, whereas the inner volumes of the spaces 10, 10 . . . 10 formed in the low pressure side fluid passage 16 gradually decrease, so that the pressurized fluid flows in order into the spaces 10, 10 . . . 10 during the passing through the fluid passage 15 and the pressure-lowered fluid L as shown by a full line after the working is returned to the tank through the port 18 and the passage 20 by the communication of the low pressure side spaces 10, 10 . . . 10 with the fluid passage 16.

When the pintle 2 is moved leftwards, as viewed in FIG. 3, so that the axis of the pintle 12 coincides with the rotation center 0 of the rotary body 12, the axis of the bushing 9 coincides with the line extending in the radial direction of the rotary body 12, thus causing no couple of forces and resulting in the generation of zero rotating force of the rotary body 12. When the pintle 2 is moved further leftwards, the rotation center 0 of the rotary body 12 is made eccentric on the side opposite to that of the above, and hence, the rotary body 12 is subjected to a rotating force reverse to that of the above.

Here, although the detailed description regarding the operation of the fluid energy convertor according to the present invention as a pump, as shown by a dotted line in FIG. 1, is omitted, the embodiments as the pump or motor of the fluid energy convertor of the present invention will be represented in the following Table 1 in combination of the rotating direction and the eccentric direction of the rotary body 12.

TABLE 1

| Eccentric Direction | Rotating Direction: Shown State | Rotating Direction: State Opposite the Shown State |
|---|---|---|
| Shown State | Motor | Pump |
| State Reverse to Shown State | Pump | Motor |

As can be understood from Table 1, when the direction of the couple of forces applied to the rotary body 12 coincides with the rotating direction thereof, the fluid energy convertor acts as a motor, whereas when the direction of the couple of forces applied to the rotary body 12 is reverse to the rotating direction thereof, the fluid energy convertor acts as a pump.

In the principle of generation of the rotating force, a pair of forces having different operating directions from each other and having the same strength, i.e. the couple of forces, do not select the acting point. Accordingly, when the couple of forces is applied to a member formed integrally with the rotation axis, the couple of forces is deemed to act on the center of the rotation axis, even if the couple of forces is applied to any portion and from any direction. Namely, as illustrated as a model in FIG. 4, optional couple of forces A, A and the couple of forces B, B are composed, the forces are represented as C=C as vectors, thus becoming zero. Accordingly, no thrust force and radial force is applied to the rotation axis of the rotary body and only the rotating force is applied thereof, which is hence taken out (see also the relevant description of Japanese Patent Publication No. 64-8190).

As described hereinabove, the fluid energy convertor of the present invention utilizes the same theory as that of the prior art described herein first, but according to the present invention, the respective constructional members such as main bodies, rotary body, pintle, and cylinder barrel, which are relatively easily worked, are assembled in a fitting manner, so that the fluid energy convertor can be made compact, resulting in the easy assembly of the same to the required portion. Moreover, since the sliding speed of the sliding surfaces of the respective members can be made small, the sliding resistance can be also reduced, resulting in the provision of an effective fluid energy convertor.

What is claimed is:

1. A rotary-type fluid energy convertor comprising:

a pair of cylindrical body members stationarily installed and and having at least a fluid inlet of high pressure side;

a pintle inserted into said cylindrical body members and having a cylindrical central portion positioned between said cylindrical body members;

an annular cylinder barrel mounted on an outer peripheral surface of said cylindrical central portion of the pintle, said cylinder barrel being provided with a plurality of spaces formed in isometrically symmetrical arrangement in radial directions thereof;

a plurality of bushings fitted into and supported by said spaces, respectively and each of said bushings having a flat outer end provided with a top edge portion and a hole;

a cylindrical rotary body mounted to said body members to be rotatable and having an inner periphery sectioned into a plurality of flat surface portions against which the flat outer ends of said bushings closely abut, respectively, so as to form pressure chambers each between the flat surface portion of the rotary body and the flat outer end of the bushing; and fluid passage means including high and low pressure side fluid passages formed between said cylinder barrel and the cylindrical portion of said pintle;

said pintle being disposed in said body members so as to be parallelly movable in a direction normal to the axis of said body members so that an amount of eccentricity between a center of the cylindrical portion of the pintle and a rotation center of the rotary body is adjustable, said pintle being provided with fluid passages which communicate the pressurized fluid to the body members with ports formed to said high pressure side fluid passages, and said body members being provided with a pair of high and low pressure side pressure chambers at portions symmetrical with respect to said high and low pressure side fluid passages, respectively.

2. The fluid energy convertor according to claim 1, wherein pressure chambers are formed to the inner surfaces of both the sides of the rotary body in correspondence to the flat surface portions thereof, respectively, at portions with an angle of 180 degrees and the pressure chambers are communicated with the high and low pressure side pressure chambers of the body members.

3. The fluid energy convertor according to claim 2, wherein the pressure chambers are formed as arcuate recesses formed in the inner peripheral surface of the rotary body.

4. The fluid energy convertor according to claim 3, wherein each of the recess has a sectional area half of a sectional area of the bushing.

5. The fluid energy convertor according to claim 1, wherein the pintle is provided with flat shaft portions, to be inserted into the body members, respectively, on both sides of the cylindrical central portion, the body portions are provided with flat inner surfaces engageable with the flat shaft portions of the pintle when inserted, and the body member has an inner diameter larger than an outer diameter of the shaft portion so that the shaft portion is eccentrically movable in the body member.

6. The fluid energy convertor according to claim 1, wherein the pressure chamber at the top flat end of the bushing formed by the abutment with the flat surface portion of the rotary body is communicated with the spaces formed in the cylindrical barrel through the hole.

* * * * *